US005360525A

United States Patent [19]

Dyke et al.

[11] Patent Number: 5,360,525

[45] Date of Patent: Nov. 1, 1994

[54] APPARATUS FOR MAKING METAL FOIL

[75] Inventors: David E. Dyke, Shaker Heights, Ohio; Wayne Neilson, San Marcos, Calif.

[73] Assignee: United Foils Inc., San Marcos, Calif.

[21] Appl. No.: 33,187

[22] Filed: Mar. 16, 1993

[51] Int. Cl.[5] ..... C25C 7/08; C25D 1/04

[52] U.S. Cl. ..... 204/216; 204/281; 204/279

[58] Field of Search ..... 204/215–217, 204/212, 281, 279; 205/152

[56] References Cited

U.S. PATENT DOCUMENTS

| | | | |
|---|---|---|---|
| 2,044,415 | 6/1936 | Yates | 204/216 X |
| 2,944,954 | 7/1960 | Yeck | 204/216 |
| 3,461,046 | 8/1969 | Clancy | 204/216 X |
| 3,767,537 | 10/1973 | Selker | 204/216 X |
| 5,019,221 | 5/1991 | Khalid et al. | 204/216 X |

*Primary Examiner*—Donald R. Valentine
*Attorney, Agent, or Firm*—McaAndrews, Held & Malloy, Ltd.

[57] ABSTRACT

A portable drum machine for producing electrodeposited copper foil continuously is disclosed. The drum machine has an electrolyte supply system which supplies copper ions at a substantially uniform composition. The machine produces copper foil that may be taken directly to a foil surface treatment system or rolled for treatment later. The result is a readily replicable, highly standardized computer-aided design stored on discs or in computer memory. A drum of readily fabricated design is made of three different metals designed for minimum voltage loss and uniform current distribution. The machine also incorporates a dimensionally stable anode precision-produced by ring-rolling concentric with the drum. Low-loss electrical connections are symmetrically configured. A spray reactor is provided for dissolving scrap metal or foil scrap. The system can be electrically and chemically isolated from other machines. There is also apparatus for thoroughly washing the foil with electrolyte and water. A directly coupled positive drum drive is coordinated with a controlled-tension windup of foil in roll form.

20 Claims, 10 Drawing Sheets

APPARATUS FOR MAKING METAL FOIL

BACKGROUND OF THE INVENTION

This invention is an apparatus for making electrolytically deposited metal foil. It is particularly adapted to the production of copper foil by electrodeposition for use in making printed circuits and to the production of a copper-containing electrolyte for use in electrodeposition.

Stemming from the pioneering work of Thomas A. Edison and others around the turn of the twentieth century, as evidenced by Edison U.S. Pat. No. 1,417,464, issued in May 1922, continuous electrodeposition of metal foils, particularly of copper, iron, and nickel, has been carried out successfully in many commercial operations. Another early example of such work is given in U.S. Pat. No. 2,044,415, issued to Yates in June 1936. Copper, by far the most deposited metal foil on a world-wide basis, is one of three major raw materials necessary for the manufacture of printed circuit boards, the other two required raw materials being a base or board of fiberglass or phenolic material and an epoxy or other bonding chemical. Following lamination to a suitable electrically insulating base and etching to remove unwanted copper, the foil becomes the medium for the physical support and electrical interconnection of electronic components in a large number of devices.

Commercial copper-foil operations have been developed in the United States of America and Canada, Europe, and Asia by a number of manufacturers. However, each of these manufacturers has tended to develop pieces of foilmaking equipment as custom items on a proprietary, in-house basis. There is no source for the basic equipment used to manufacture foils in the standard widths and thicknesses. These standard foil thicknesses are 2 ounces per square foot (70 microns thick); 1 ounce per square foot (35 microns thick); ½ ounce per square foot (17 microns thick) and ⅓ ounce per square foot (12 microns thick). The standard foils are and probably will continue to be in high demand. Apart from standardization that has been achieved on specific widths and gauges required in manufacturing, production of the foil has usually relied upon internally developed equipment without overall standardization, although there have been and continue to be attempts at standardization of the basic equipment within particular organizations. Foil manufacturers have relied on their own varied designs and equipment assembled from a variety of components procured from a variety of manufacturers. Inevitably, that approach has been costly, resulting in many failures and much unnecessary replication of design effort on what by other standards is rather simple equipment.

Such a situation has significantly slowed the growth of the foil business, which today remains both somewhat slow to change techniques and also very capital-intensive. Moreover, emerging electronics industries in several parts of the world, particularly in Asia, have been discouraged or prohibited from acquiring captive foil operations because they have no manufacturer of standard equipment to turn to. This is not the case in the follow-on or allied parts of the printed-circuit industry, where there are many competitive manufacturers of specialized items of equipment. For example, where are over the world several alternative manufacturers of laminating presses and of machinery to print and etch the laminates to produce circuit boards. In developing nations an emerging electronics industry typically integrates backwards. Assembly of electronic equipment comes first, followed by the acquisition of printed circuit manufacturing capabilities, followed by laminating capabilities. A major road block to full backwards integration to produce all raw materials is the lack of standardization and the unavailability of foil-making machinery.

Most of the copper foil that is used in printed circuits is electrodeposited on metal drums that range in diameter from about 15 inches (38 cm.) to about 118 inches (3 meters) and in width from about 40 inches (90 cm.) to about 118 inches (3 meters). Spacings between anodes and drums are generally in the range of the order of ¼ inch (6 mm.) to 1 inch (25 mm.). Electrolytes are typically aqueous solutions of sulfuric acid and copper sulfate, with concentrations of copper as metal ranging from about 50 to about 115 grams per liter and of sulfuric acid ranging from about 70 to about 140 grams per liter. The electrolyte is supplied at solution flow rates of about 25 to 1250 gallons per minute (100 to 5000 liters per minute) and at temperatures ranging from about 50 C. to 70 C. Current densities range from about 150 amperes per square foot to about 1500 amperes per square foot (1500 to 15,000 amperes per square meter). Properties of electrodeposited copper foil may also be influenced by the presence of additives in the electrolyte, including chloride ions from the addition of hydrochloric acid and organic materials such as glue, gelatine, hydroxyethyl cellulose, and the like.

Some of the problems in producing electrodeposited foil and some alternative solutions to the problems are discussed in a number of patents including U.S. Pat. No. 4,869,971, issued Sep. 26, 1989, entitled "Multilayer Pulsed-Current Electrodeposition Process." This patent summarizes the state of the art in electrodeposition and also shows how to electrodeposit multiple layers from a single solution. U.S. Pat. No. 4,898,647, issued Feb. 6, 1990, entitled "Process and Apparatus for Electro-plating Copper Foil," teaches a version of a rotating drum for electrodeposition and also a concentric anode. An alternative version of an anode for electroplating copper foil is given in U.S. Pat. No. 4,913,973, issued Apr. 3, 1990, entitled "Platinum-Containing Multilayer Anode Coating for Low pH, High Current Density Electrochemical Process Anodes." This patent describes some of the problems that are overcome in that patent by using a specially treated plating of platinum as the anode surface.

A process of treating foil after it is electroplated is given in U.S. Pat. No. 4,952,285, issued Aug. 28, 1990, entitled "Anti-Tarnish Treatment of Metal Foil." The metal foil in question is copper or copper alloy which is treated with an aqueous solution of chromic acid and sulfuric acid, after which it is rinsed and dried. Another example of technology that is currently in use is taught by U.S. Pat. No. 4,956,053, issued Sep. 11, 1990, entitled "Apparatus and Process for the Production of Micro-Pore Free High Ductility Metal Foil." The '053 patent teaches the use of an electroplating drum with an anode of lead, alloys of lead and antimony, antimony, or alloys of lead, antimony, and silver. U.S. Pat. No. 4,961,828, issued Oct. 9, 1990, entitled "Treatment of Metal Foil," teaches a system for producing metal foil electrolytically and treating it chemically.

U.S. Pat. No. 4,976,826, issued Dec. 11, 1990, entitled "Method of Making Electrodeposited Copper Foil,"

teaches adding a water-soluble cellulose ether to the electrolyte to assist in depositing a smooth foil. Another drum for electroplating metal foil is taught by U.S. Pat. No. 5,019,221, issued May 28, 1991, entitled "Electroplating Drum with High Current-Carrying Capability."

All of these patents show aspects of the present state of the art in the making and treating of electrodeposited foil, particularly copper foil. They also share one or more of the following disadvantages. Those that show electrical connections to the shaft of a rotating drum show the connection on only one end of the shaft, which causes some difficulties in maintaining a uniform current density at the surface of the drum. Those that show a supply of electrolyte entering along the bottom of a drum do not show any apparatus for maintaining turbulent flow of the electrolyte during electrolysis to supply metal ions in a relatively high concentration at the surface of the drum and to remove the oxygen evolved in the reaction from the reaction site. None of these references shows an apparatus for dissolving copper in sulfuric acid efficiently.

SUMMARY OF THE INVENTION

It is an object of the invention to provide a better means for manufacturing electrodeposited metal foil.

It is a further object of the invention to provide a better means for manufacturing electrodeposited copper foil.

It is a further object of the present invention to provide an apparatus for making copper foil that provides for substantially uniform current density over the surface of a drum by making dual electrical connections at two ends of the drum shaft and by choice of different metals and their placement inside the drum.

It is a further object of the invention to provide a better way of dissolving copper in an electrolyte for use in electrodeposition of copper foil on a drum.

It is a further object of the invention to provide an anode that has a substantially uniform distribution of current to a drum.

These and other objects of this invention are achieved by an improved basic and highly standardized drum machine for producing electrodeposited foil continuously. The drum machine is connected to an electrolyte supply system that includes an improved means for dissolving copper in the electrolyte and supplying an electrolyte containing copper ions at a substantially uniform composition. This apparatus is easily disassembled to fit in a standard shipping container and is readily assembled and installed at a job site. The system produces foil that may be taken directly to a foil treatment system to treat the surfaces of the foil or it may be operated to produce rolls of foil that are later unrolled to supply foil to a treater. The result is a readily replicable, highly standardized computer-aided design stored on discs or in computer memory, requiring a minimum number of materials.

The invention incorporates a drum of readily fabricated design comprising three different metals designed for minimum voltage loss and uniform current distribution. It also incorporates a dimensionally stable anode that is precision-produced by ring rolling to be concentric with the drum and is designed for minimum voltage loss and minimum variation of the current distribution. Low-loss electrical connections to the drum are symmetrically con-figured. A spray reactor is provided for dissolving scrap metal or foil scrap. The spray reactor is electrically and chemically isolated from other machines.

The system of the present invention can be taken apart into a small set of subassemblies that can be shipped in standard freight containers. It may incorporate in-line filtration to limit particulate intrusion into the electrodeposition zone and also a reliable device to limit foil width so that it is unnecessary to produce foil that is greater than a desired width and then trim it to size, producing scrap. There is also a means for thoroughly washing the foil with spent electrolyte and water. A directly coupled variable-speed positive drum drive is coordinated with a controlled-tension windup of foil into a roll. The operation of the process is monitored and controlled by a microprocessor or microcomputer that responds to the principal independent variables. These include current, drum rotational speed, chemical composition of the electrolyte, temperature of the electrolyte, flow rate of the electrolyte along the surface of the drum, impurities in the electrolyte, and additives to the electrolyte.

DETAILED DESCRIPTION OF THE INVENTION

Figure 1:
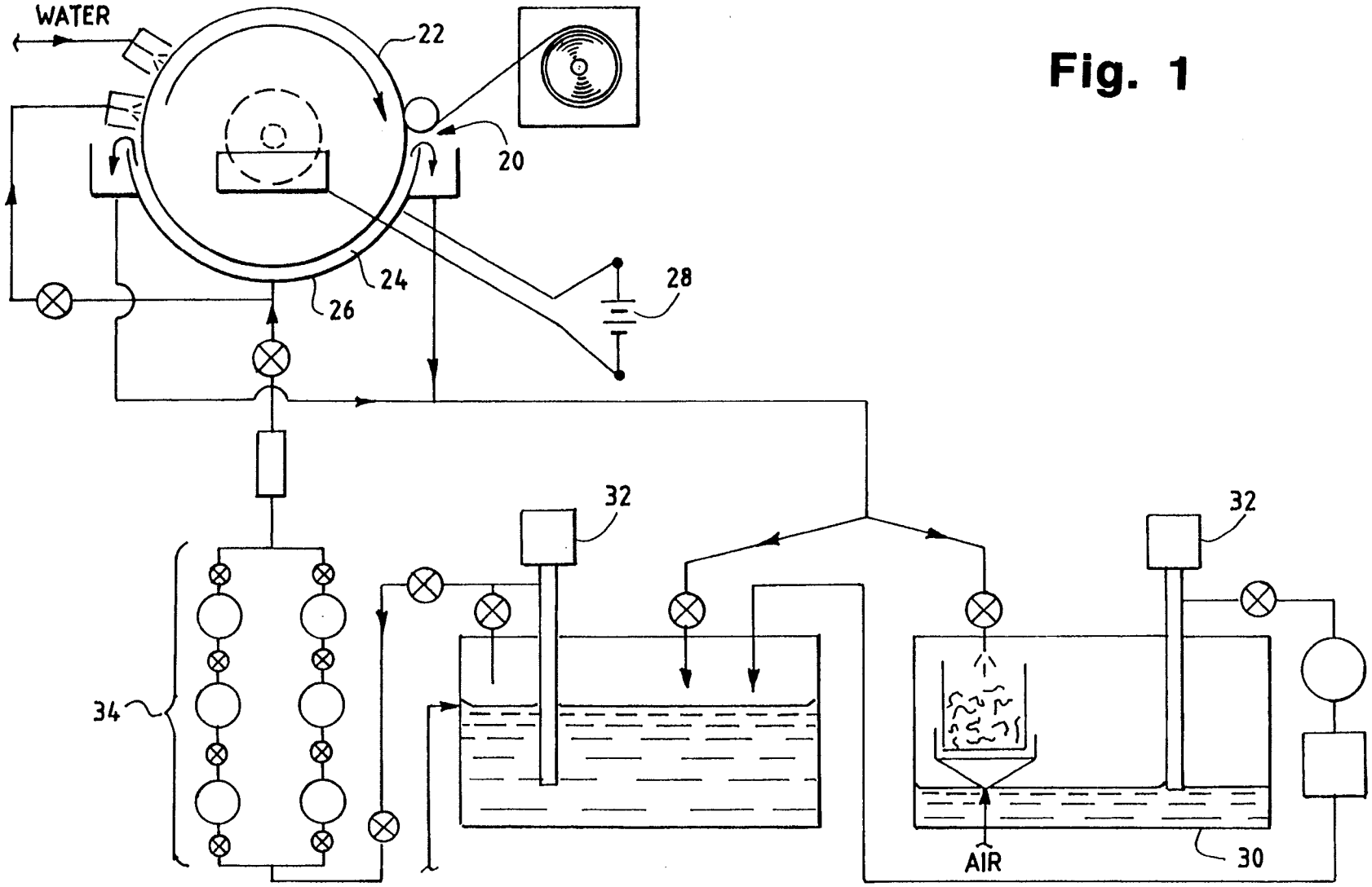
FIG. 1 is an overall schematic diagram of a system for electrodeposition and treatment of metal foil.

FIG. 1 is an overall schematic diagram of a system for electrodeposition of metal foil. In FIG. 1, a drum assembly 20 includes a drum 22 that rotates in a solution 24 that is in an anode 26. An electrical supply 28 is connected to the drum 22 and to the anode 26 to complete an electric circuit through the drum 22, the solution 24, and the anode 26. The solution 24 contains ions of the metal that is to be electrodeposited on the drum 22. The solution 24 is supplied from a dissolving tank 30 by a pump 32 through a filter 34 to the anode 26. Spent solution 24 is returned to the dissolving tank 30 to restore the concentration of ions. Where the desired foil is copper, the solution 24 is preferably aqueous copper sulfate that is formed by dissolving copper in sulfuric acid.

Figure 2:
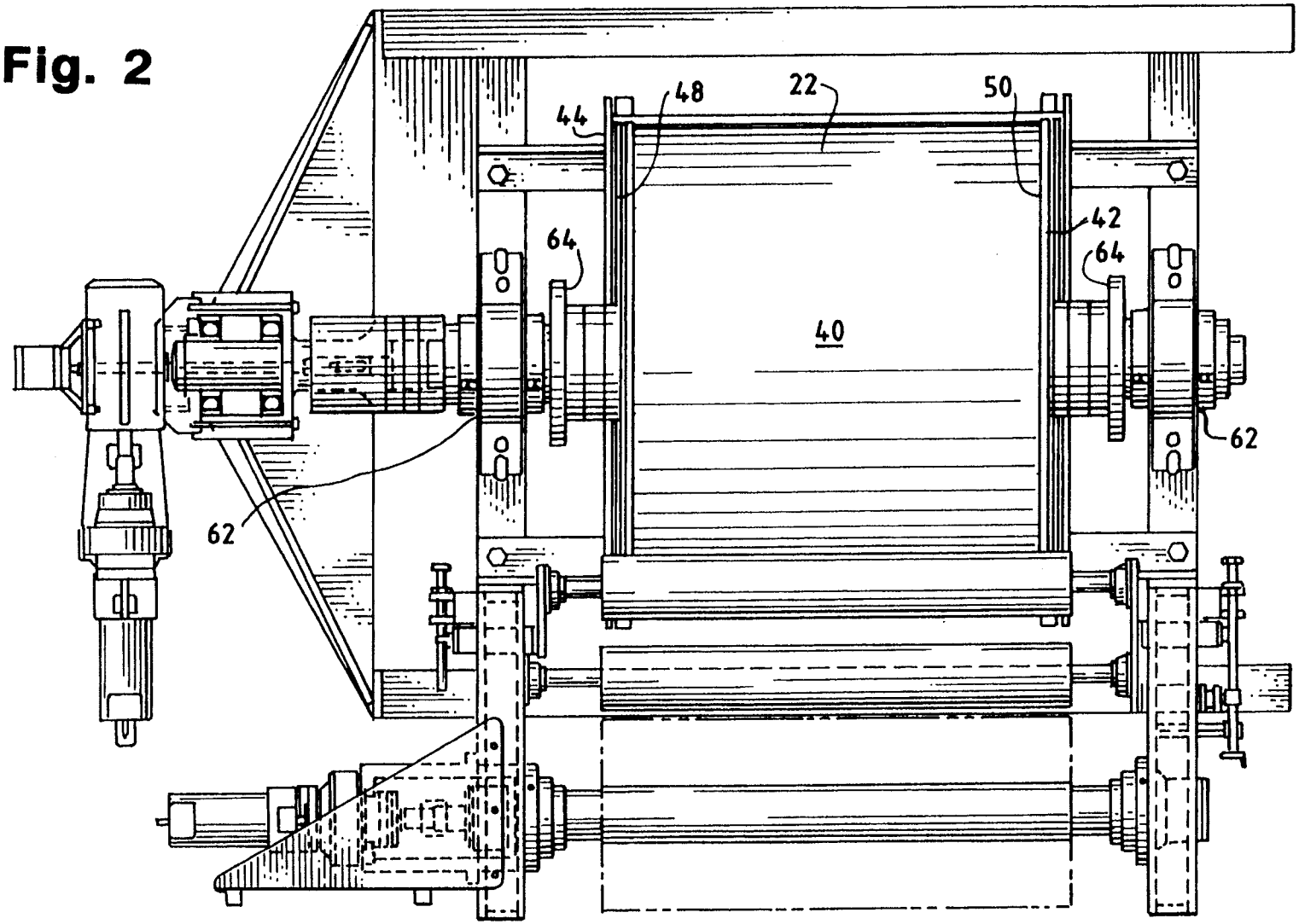
FIG. 2 is a top view of a drum assembly for the practice of the present invention.
Figure 3:
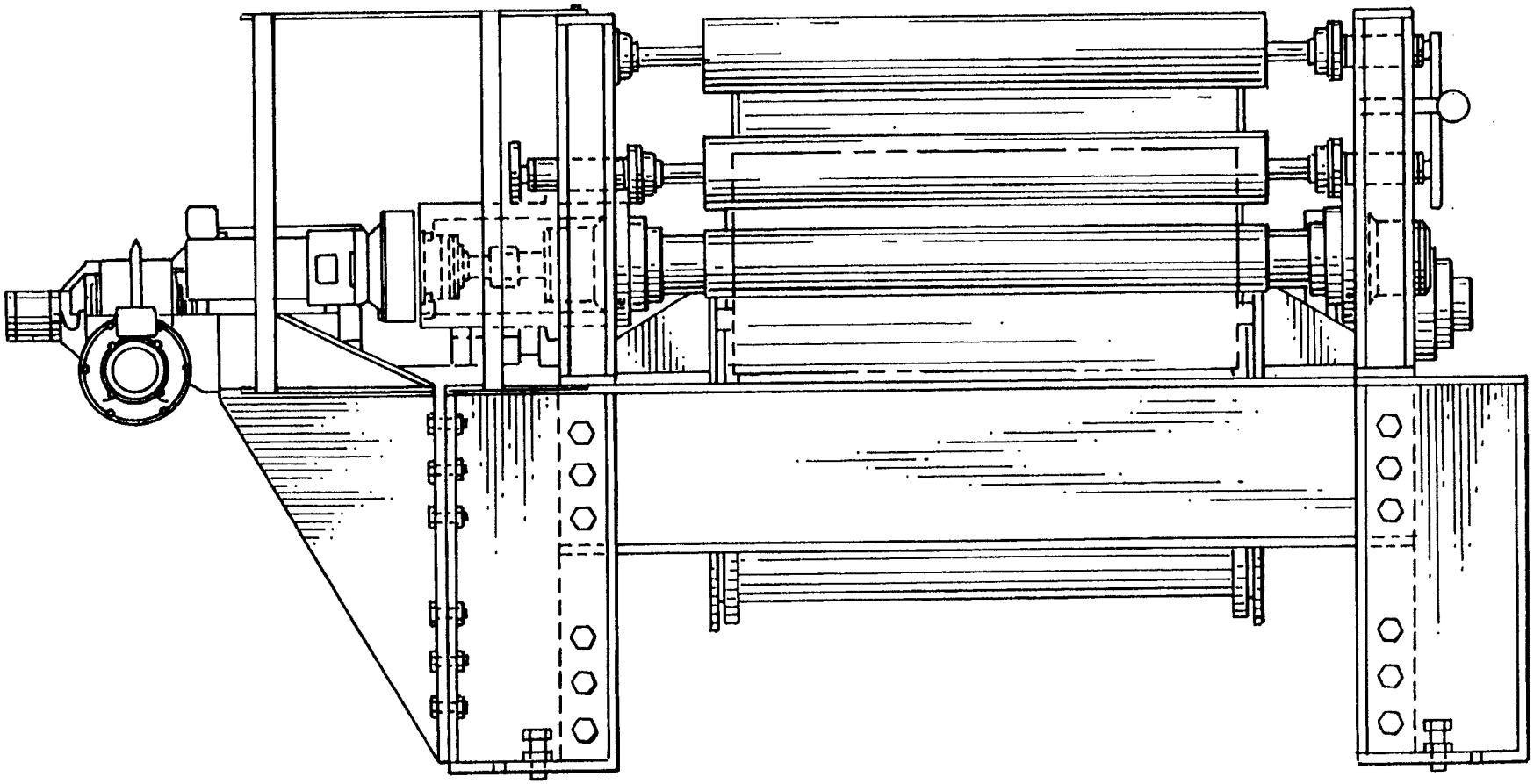
FIG. 3 is a side view of the drum assembly of FIG. 2.
Figure 4:
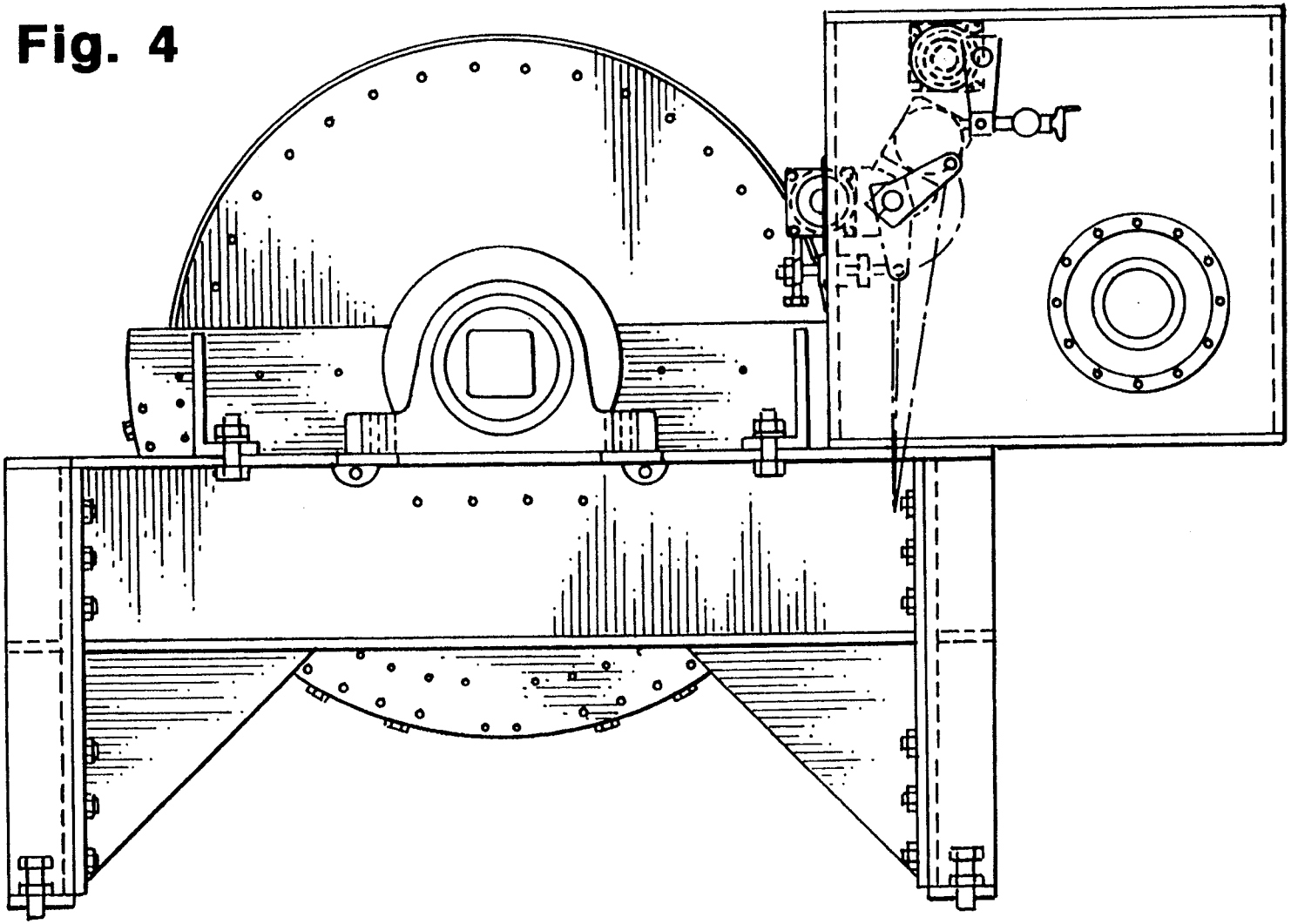
FIG. 4 is an end view of the drum assembly of FIG. 2.
Figure 5:
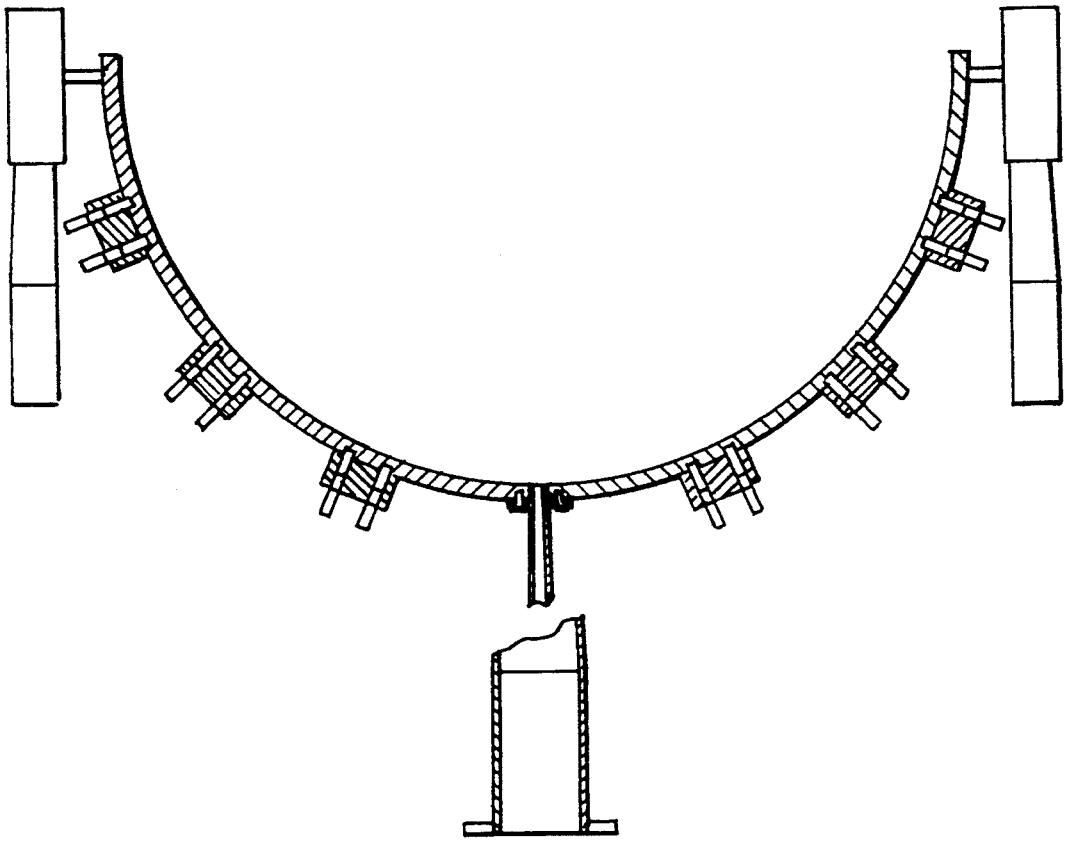
FIG. 5 is a cutaway view of a portion of the drum assembly of FIG. 2.

FIG. 2 is a top view of a drum assembly for the practice of the present invention, FIG. 3 is a side view of the drum assembly of FIG. 2, FIG. 4 is an end view of the drum assembly of FIG. 2, and FIG. 5 is a cutaway view of a portion of the drum assembly of FIG. 2. In FIGS. 2–5, the drum 22 comprises a titanium-clad cylinder 40 divided between two plastic end discs 42 and 44 containing machined channels 46 in which O-rings 48 and 50 are fitted to limit the width of the foil and prevent electrodeposition around the edges of the drum 22. The shaft 60 of the drum 22 has bearing surfaces 62 at either end and integral location rings 64 machined in it for precision location. The drum 22 has a metal disc 64 at either end that is bolted to the ends of the shaft 60 that are partially immersed in molten metal 66 contained in thermal and electrically insulating troughs 68. The plastic end discs 42 and 44 are formed in two halves and are attached by screws 70 positioned in holes 72 around the periphery of the drum 22 and in holes 74 around the shaft 60 of the drum 22 on both ends of the drum 22. Turbulent flow of the electrolyte in the region between the drum and the anode is maintained by shaping the transition assembly to have essentially a constant cross-sectional area from its initial connection to a round pipe until it reaches the shape of the slit between sections of the anode.

In the preferred embodiment, both the drum 22 and the anode 26 are made from billets of titanium that are pierced and rolled into cylindrical shells on the same rollers. The anode cylinder is rolled to have an inside diameter that is slightly larger than the outside diameter of the drum. The outside of the drum 22 is then machined, typically by grinding it, to provide a surface upon which foil is electrodeposited. The inside of the anode cylinder is also machined and then the anode cylinder is cut into four quadrants, two of which are used for segments of the anode. Because the anode cylinder and the drum are rolled on the same machinery, it is possible to make them concentric to a relatively high degree of precision and thus spaced apart with precision, typically at a spacing of about 5 millimeters. This contributes to the uniformity of current flow and hence to uniformity of deposition of foil on the drum.

The inside of the drum 22 and the outside of the anode cylinder are machined only to make electrical and structural connections. Otherwise they can be left as rolled. The concentric titanium anode is in contrast to the lead or lead alloy usually used for anodes in electrodepositing copper foil on drums. It results in an absence of metallic particles in the electrolyte that must be filtered out, a characteristic of lead or lead alloy anodes. The titanium anodes are also much less prone to erode, changing the local spacing between the anode and the drum.

Figure 6:
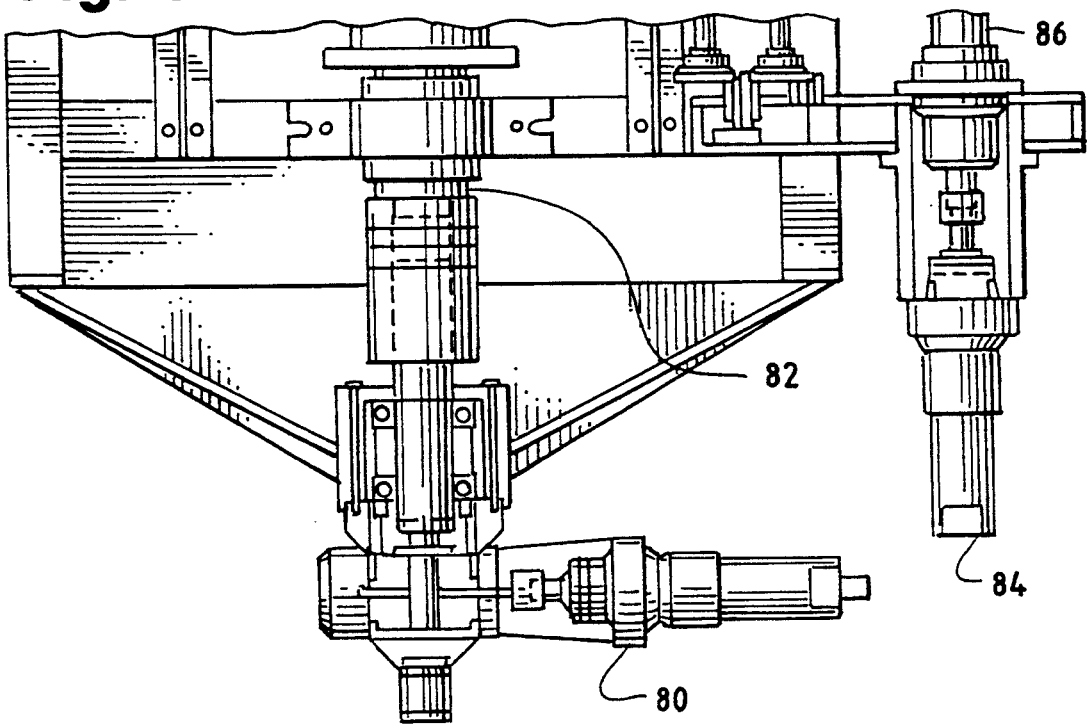
FIG. 6 is a top view of a portion of the drive assembly of the present invention.
Figure 7:
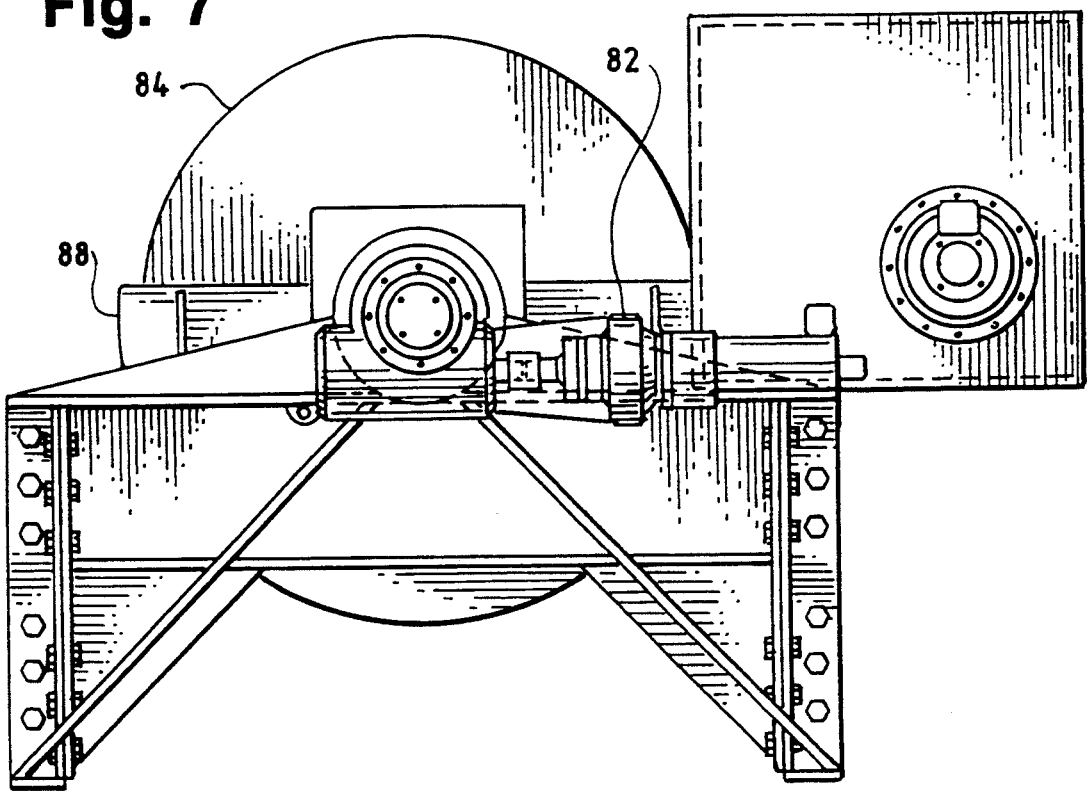
FIG. 7 is an end view of the drive assembly of FIG. 6.

FIG. 6 is a top view of a portion of the drive assembly of the present invention and FIG. 7 is an end view of the drive assembly of FIG. 6. In FIGS. 6 and 7, a drive motor 80 drives the shaft 82 of the drum 84 and a takeup drive motor 84 drives a mandrel 86 that collects electrodeposited foil. An anode 88 contains the electrolyte that is pumped in through a solution transition assembly that is not shown here.

Figure 8:
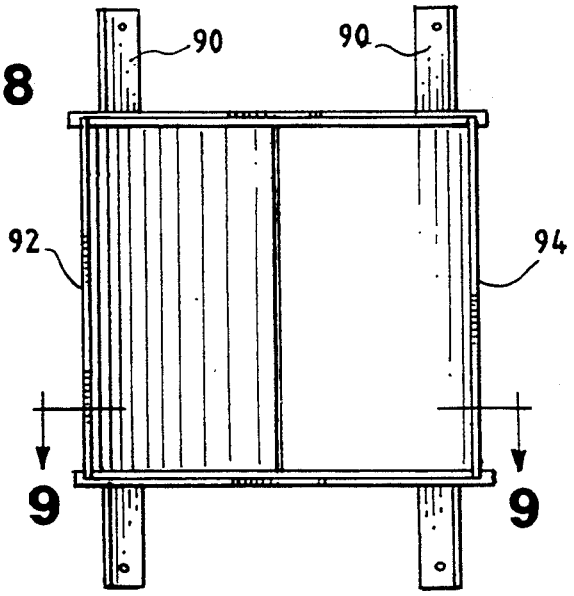
FIG. 8 is a top view of the anode of the present invention.
Figure 9:
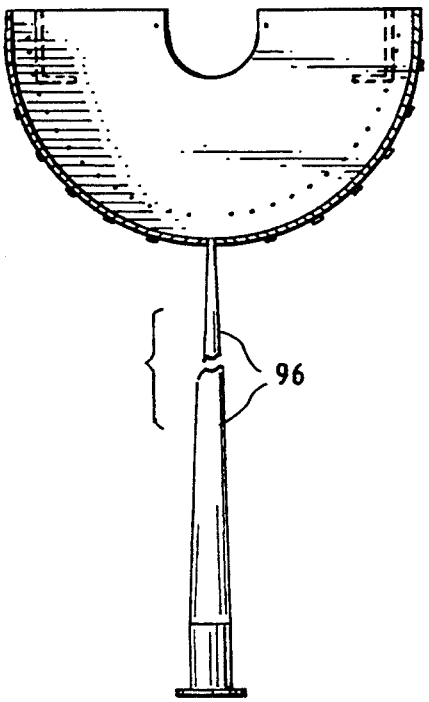
FIG. 9 is a sectional end view of the anode of FIG. 8, taken along section lines 9—9 of FIG. 8.

FIG. 8 is a top view of the anode of the present invention, FIG. 9 is a sectional end view of the anode of FIG. 8, taken along section lines 9—9 of FIG. 8, and FIG. 9*a* is a front view of the anode of FIG. 8. In FIGS. 8 and 9, the brackets support the anode sections 92 and 94 that are connected to the solution transition 96.

Figure 10:
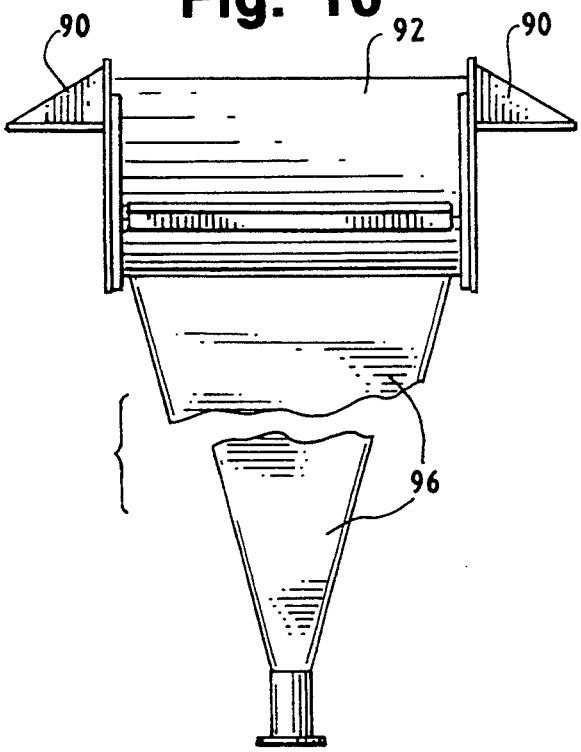
FIG. 10 is an expanded sectional view of the connection of the solution transition input assembly to the anode.
Figure 12:
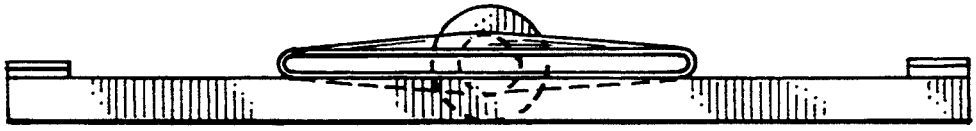
FIG. 12 is an end view of the solution transition input assembly.
Figure 11:
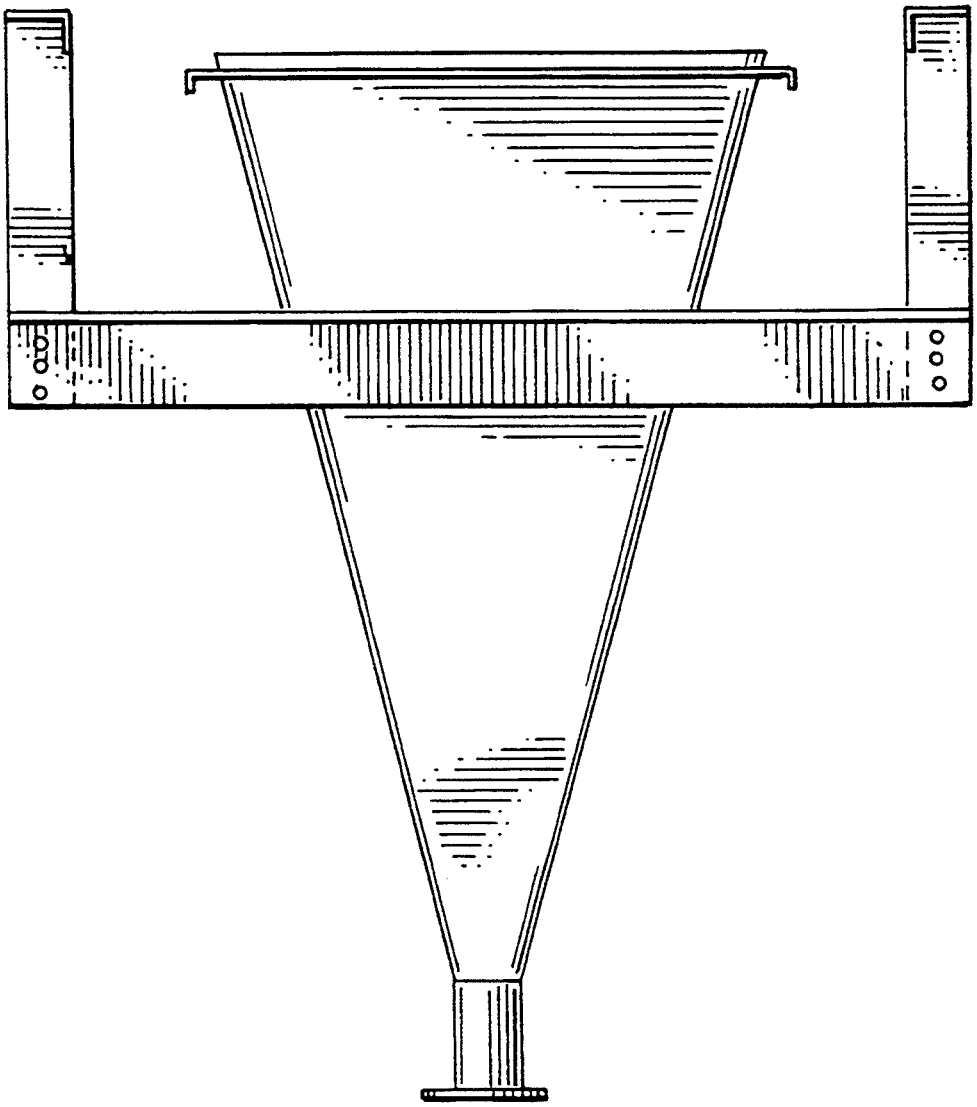
FIG. 11 is a side view of the solution transition input assembly.

FIG. 10 is an expanded sectional view of the connection of the solution transition input assembly to the anode, FIG. 11 is a side view of the solution transition input assembly, and FIG. 12 is an end view of the solution transition input assembly. The solution transition assembly fits a round pipe to the slot in the anode to supply electrolyte in isotropic turbulent flow between the drum and the anode.

Figure 13:
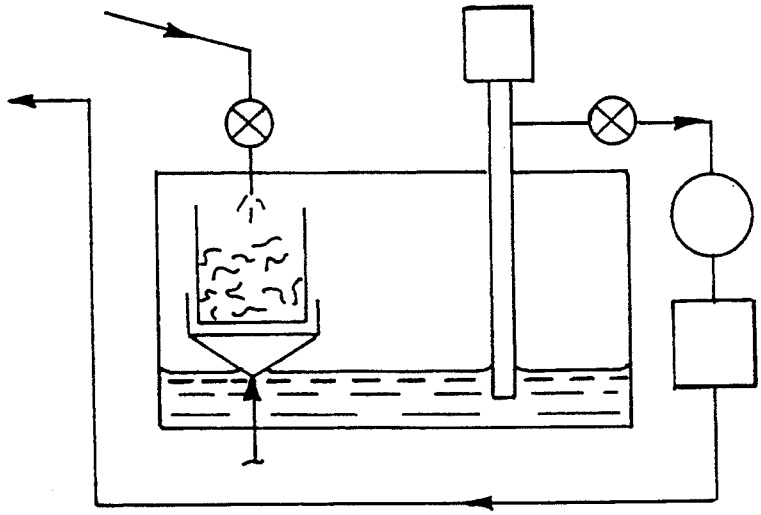
FIG. 13 is a view of an apparatus for dissolving metal to be plated.

FIG. 13 is a view of an apparatus for dissolving metal to be plated. In FIG. 13, a rectangular container (1) made of suitable metal such as 316L stainless steel or plastic such as polypropylene is equipped with a submersible centrifugal circulation pump (2) to circulate liquid (3) collected in the base of the container (1) after solution to be replenished is sprayed through nozzles (5) positioned above containers of metal scrap (6). The scrap containers (6) are positioned above a Buchner funnel arrangement (7) through which pressurized air flows from a pipe (8) connected to a suitable blower, the air ascending through the mass of metal scrap as the spent electrolyte sprays onto and percolates downward through the metal scrap mass. The scrap reactor container vessel (1) is equipped with lids (4) for ready insertion and removal of scrap containers.

The dissolving vessel, typically of rectangular shape, has a pump (2) to circulate solution from it to the reservoir tank (not shown) of the drum machine solution circulation system. Solution for reaction with the copper scrap flowing from the drum machine enters the dissolving vessel via tubes indicated by arrows terminating in downward pointing spray nozzles (3) like shower heads that spray the solution downward onto loosely packed piles of scrap copper into cylindrical containers (dotted outline form (5)) placed immediately below lids (4) in the top surface of the dissolving vessel through which the containers of scrap copper can be inserted or withdrawn.

Figure 14:
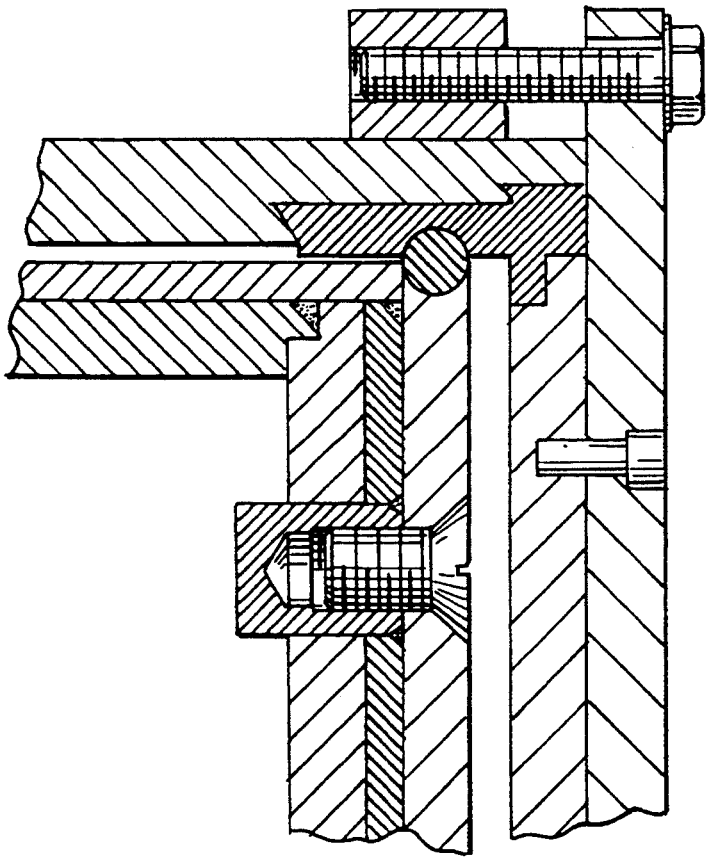
FIG. 14 is a detail of the end of the drum including the O-ring.

FIG. 14 is a detail of the end of the drum including the O-ring. The O-ring seals electrolyte in a region formed by the drum and the anode, making it easier to keep acid clear of the bearings on which the drum rotates.

Figure 15:
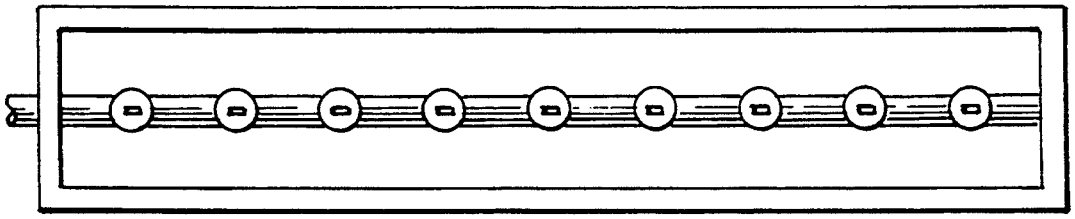
FIG. 15 is a view of a spray nozzle for use in dissolving foil.

FIG. 15 is a view of a spray nozzle for use in dissolving foil. The spray nozzle may either rotate or remain fixed over the basket of FIG. 13.

Figure 16:
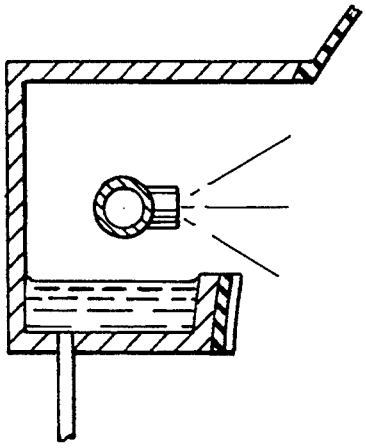
FIG. 16 is a cutaway side view of a foil rinse box to wash foil electrodeposited on the drum.
Figure 17:
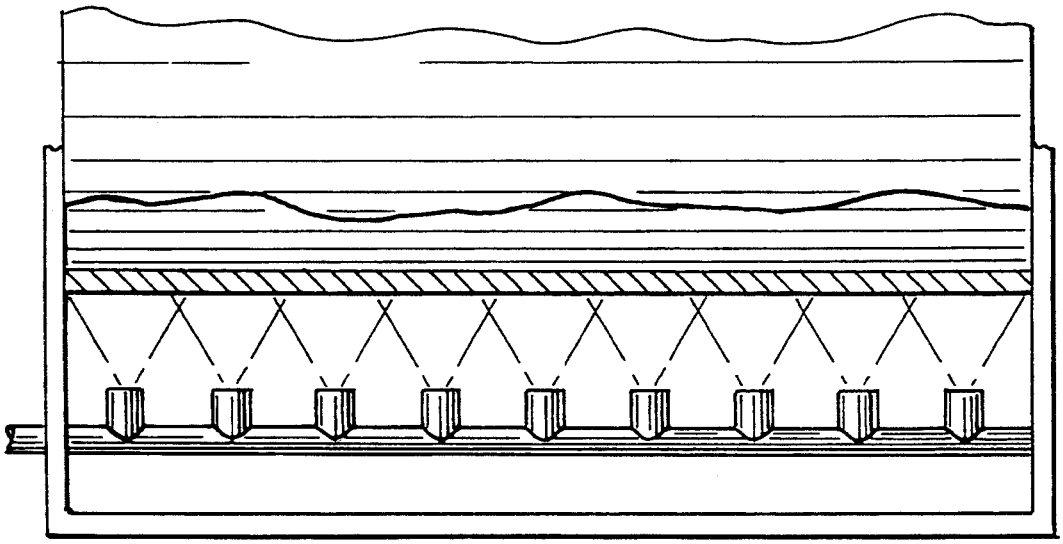
FIG. 17 is a top view of the foil rinse box of FIG. 16.

FIG. 16 is a cutaway side view of a foil rinse box to wash foil electrodeposited on the drum, and FIG. 17 is a top view of the foil rinse box of FIG. 16. In FIGS. 16 and 17, a wiper contains the rinse water to keep it from diluting the electrolyte.

The drum machine electrical configuration is connected to the drum 22 positioned symmetrically above two anode quadrants having upper edges, the shaft of the drum being supported on suitable bearings and equipped on either end with a metal disc attached to it by screws. The discs make electrical contact with pools of molten alloy held in suitable troughs to which are attached the bus bars connecting the molten metal pools to the negative terminals of an electrical source, typically two high-amperage low-voltage direct-current rectifiers. The positive terminals of the rectifiers are connected by suitable bus bars to the back of the anodes.

The lengths and cross-sectional areas of the bus bars are adjusted so that the small voltage losses in them are identical.

In the continuous electrodeposition of copper as foil from sulfate solution it is common to use an insoluble anode when the principal reaction at the cathode may be written as:

$$Cu^{2+}+2e \rightarrow Cu^{\circ}$$

and that at the anode as:

$$H_2O-2e \rightarrow 2H^{+}+\tfrac{1}{2}O_2$$

indicating that oxygen gas is evolved at the anode and the overall electrochemical reaction including the sulfate ion may be written as:

$$\tfrac{1}{2}O_2+2H^{+}+2e \rightarrow H_2O$$

For every gram atom of copper deposited as foil, one gram molecular weight of sulfuric acid is liberated and one half of one gram molecular weight of oxygen gas is liberated as bubbles at the anode.

Electrolyte overflowing the anodes in the drum machine is reacted with metal scrap and that reaction to dissolve copper into the solution to replace the copper that has been electrodeposited as foil, also can be imagined as an electrochemical reaction, composed of two parts, a reaction at cathodic sites as the surface of the metal scrap written as:

$$\tfrac{1}{2}O_2+2H^{+}+2e \rightarrow H_2O$$

and a corresponding reaction at anode sites written as:

$$\tfrac{1}{2}O_2+Cu^{\circ}+H^2SO_4 \rightarrow CuSO_4+H_2O$$

so that the overall reaction representing dissolution of copper scrap may be written as:

$$\tfrac{1}{2}O_2+Cu^{\circ}+H^2SO_4 \rightarrow CuSO_4+H_2O$$

Every gram atom of copper dissolves by reaction of one half of one gram molecule of oxygen and one gram molecule of sulfuric acid to form one gram molecule of copper sulfate and one gram molecule of water.

In that respect, the reaction representing the dissolution of copper scrap is the reverse of the overall reaction occurring in the electrodeposition cell of the drum machine. By proper arrangement of dissolving conditions, there can be a perfect materials balance in which every unit weight of copper extracted from the solution as foil is simultaneously replaced by the same unit weight of copper dissolved from the mass of copper scrap. In that way the drum machine is a means of electrolytic recycling in which discrete pieces of scrap copper are transformed into a continuous wide web of thin usable foil and the composition of the electrolyte solution comprising copper sulfate, sulfuric acid and water substantially is held constant.

The deposited foil is washed first with electrolyte that is allowed to trickle back .into the drum supply to be recirculated. The foil is then washed with water that is kept from the electrolyte by a squeegee that rides on the foil to provide a seal. Enough of the wash water to make up for evaporation is added to the electrolyte; the rest of the water is either reused or discarded.

Scrap dissolving reactors traditionally used to support electrodeposition of foil using drum machines typically consist of large cylindrical vessels usually constructed of stainless steel essentially completely filled with electrolyte solution through which air is bubbled after being injected into the base of the dissolving vessel by nozzles supplied with air from a suitable blower. This arrangement is inefficient as can be demonstrated by a small model made from glass since most of the injected air flows in vertical channels without significantly contacting the surface of the scrap to be dissolved and at best one can say that such air agitates the liquid and in that sense assists with the removal of copper-enriched solution from the scrap surface and bringing copper-depleted solution into contact with it.

In the reactor of the present invention the air needed to react with the copper scrap is either entrained with and conveyed by the descending sprayed solution or is injected counter-current to the descending percolating solution. In either approach the objective is to arrange for the copper scrap surface to be covered by a thin layer of moving solution through which oxygen from the air in intimate contact with it can readily diffuse for reaction at the surface of the scrap to dissolve the scrap efficiently and at the rate required to replace copper in the solution at as nearly as possible the same rate at which the copper is being extracted by electrodeposition as product foil.

In FIG. 1 a cathode drum (1) provides a surface upon which the electrodeposited foil (2) is retained until it is conveyed by and underneath a roll (22) to the wind-up mechanism. The roll (22) is preferably covered with synthetic rubber or a soft plastic. The drum (1) is horizontally mounted on a shaft (3) supported by a suitable bearing (23) on each end of the shaft (3). Conforming with and placed beneath the drum (1) are quadrant anodes (5) concentric with the drum (1) between the lower ends of which electrolyte solution is injected by a pipe (6). A small fraction of incoming electrolyte flow is led by a pipe (24) through a flow meter (10), with the flow rate regulated by a valve (7), and is conveyed to a pipe to which nozzles (8) are attached arranged to spray fresh electrolyte onto the foil (2) still attached to the drum (1) as it emerges from the solution that is overflowing the upper edge of the anode (5). Nozzles (8) are distributed uniformly across that pipe to provide a uniform solution spray across the whole width of the foil (shown in the lower RH sketch in the Figure). The spray pipe is positioned inside a suitable housing (9) to contain back splashing, and solution draining from the housing (9) is returned with the solution overflowing the anodes (5) to the solution reservoir tank.

Positioned immediately above the solution spray housing (9) is a similar housing (12) containing a pipe conveying deionized water to a spray nozzle arrangement (11) which is similar in configuration with the solution spray arrangement. The deionized water is fed by pump from a suitable water purification system via a pipe (13), the flow rate of water being regulated by a valve (14) and monitored by a suitable flow meter (16).

As indicated by the arrows (4) and (15), the drum and the foil windup roll turn in the same direction at constant circumferential speed, the rotation being synchronized to maintain suitable tension in the foil conveyed from the drum. The mandrel (18) upon which the foil winds may be positioned within a housing (19) having a slot (24) to admit the foil and inside which there is a controlled atmosphere at a pressure slightly above the outside atmospheric pressure. The purpose of the controlled atmosphere, that, for example, may be simply dry warm air, is to prevent corrosive staining of the foil winding up in the somewhat humid environment near the drum machine, particularly in manufacturing plants that are not air-conditioned.

Illustrated is the lower hemicylindrical half of the drum shaft (1) in cross-section to which each end has a means for supplying exactly one half of the current I, to be used for continuous electrodeposition of the metal foil. In the preferred embodiment the current is dc, although it may be pulsed or it may be polyphase rectified from a number of phases. The shaft (1) is connected by a set of discs, two outer discs (2) and a necessary number of internal discs (3) to the underside of a cylinder shown in cross-section as (4) onto which the actual cylinder of titanium, on which foil is electrodeposited, has been fitted. That construction is preferred to using a solid drum that would be excessively heavy for the sizes typically used to produce foil, such drums typically being between 1.25 and 2.50 meters in width and between 1.0 and 3.0 meters in diameter.

Our design includes the feature that the internal discs (3) carry equal current and the two outer discs (2) together carry exactly the same current as one internal disc. In the case illustrated the total current to the drum is divided in two, with half flowing via one end of the shaft and the other half flowing through the other end of the shaft. The two external (end) discs (2) each carry one-eighth of the current for a total of one-fourth of the current while the internal discs (3) each carry also one-fourth of the current. In this symmetrical configuration the voltage drop V is uniform across the width of the drum and radially around approximately one-half of the surface that is in contact with the electrolyte solution at any time.

Drum machines are typically operated at constant current since by Faraday's law of electrolysis that current corresponds to a rate of deposition, e.g. in kg/hr, that corresponds in turn to a deposition of a fixed length of foil perimeter of constant width when the drum is turned at constant speed. The design provides for symmetrical flow of that current within the drum to provide a uniform outflow of current from the drum surface that ensures uniform weight per unit area of foil is electrodeposited over the entire active drum surface area.

Equally distributed current and equal voltage losses are arranged by selection of the size of the weldments (6) and the thickness of the welded members (discs) where they attach to the shaft (1) and to the inside of the under drum (4).

Illustrated is a transition nozzle (1) of suitable metal e.g. titanium or plastic e.g. polypropylene to convey solution from a standard round pipe (2) to a rectangular slot (3) through which the solution flows into the space between the drum and the two anode quadrants of the drum machine. The cross sectional area of the rectangular slot w.t can be made equal to the cross-sectional area of the inflow pipe $\pi D^2/4$ so that there is no back pressure exerted by the slot.

The angle the nozzle makes with the vertical should not exceed fifteen degrees otherwise the liquid flow will detach from the narrow wall and incompletely fill the wide end of the nozzle.

The length L of the nozzle is selected to be 40 times the hydraulic diameter of the rectangular entry slot. That diameter for high aspect ratio channels ($w>>t$) is defined by 4 times the cross sectional area 4 wt divided by the wetted perimeter $2w+2t$ or $4wt/2(w+t)$ that is approximately equal to 2t i.e., twice the thickness of the slot that in turn may be equal to the radial distance between the anode and drum surfaces.

According to empirical determination in the literature (Hartnett, Yoh and McComis, TVA circa 1962), arranging $L=40$ hydraulic diameter ensures that the pressure gradient in the fluid will be constant before fluid reaches the rectangular slot and turbulent flow will be full developed.

In the electrodeposition of metals it is well known that factors limit the rate of the process often expressed as current density. Cations of the metal to be plated associated with water molecules and/or certain anions arrive at the cathode by fluid transfer, diffusion and migration depending respectively on the intensity of solution agitation, the concentration gradient (bulk to cathode) and the intensity of the electric field expressed as the gradient of voltage. As can be demonstrated readily and often has been seconded in the technical literature, fluid transfer, often termed mass transfer, can be the dominant influence on the maximum achievable deposition rate. Mass transfer by turbulence, the natural interchange oscillation of adjacent segments of fluid, is known to be the most effective in transferring metal ions in support of high rate i.e. high-current-density electrodeposition.

It is important that the fluid oscillation developed is intrinsic, i.e. stemming from the local dominance of momentum over friction forces in the fluid, and not the result of external disturbances as may be caused by sharp prominences of metal or plastic intruding the space through which fluid flows, including the transition, its connection to the base of the anodes or within the space between the drum and the anodes. Under the conditions required intrinsic turbulence is assured if the Reynolds number exceeds 5000. However, we prefer to use volumetric flow rates of electrolyte solution such that the Reynolds number is at least about 10,000.

A titanium-clad, cylindrical cathode drum (1) is mounted horizontally so that both ends of its shaft (2) rest in suitable bearings (3). Positioned symmetrically beneath the drum are two quadrant anodes (4) each quadrant being equipped with suitable troughs (5) to collect overflowing electrolyte.

From collection troughs (5), one attached to the upper edge of each anode, solution that is lower in copper concentration, higher in sulfuric and concentration that the inflowing solution and containing bubbles of oxygen gas from the anodes (4) is conveyed by a pipe (11) via valves (12) both to the reservoir tank (1) and to the copper scrap dissolving reactor (13) in proportion to the requirements for maintaining substantially constant chemical composition of the electrolyte solution being fed by the pipe (6) to the drum machine.

Vessel (10), the reservoir tank, is constructed from plastic of suitable chemical resistance, such as polypropylene, or from metals or alloys of suitable chemical resistance such as chemically pure titanium or 316-L grade stainless steel.

Solution necessary to sustain the drum machine operation is returned via a suitable pump (9), through a suitable heat exchanger (8), through a suitable filter (7) to the entrance slot at the base of the two anode quadrants. We prefer to use a submersible centrifugal pump constructed of suitable corrosion resistant materials such as 316-L stainless steel, a parallel plate heat exchanger also constructed of suitable corrosion resistant materials such as 316-L grade stainless steel and a filter similarly constructed of 316-L stainless steel containing filter elements in the form of tubes (on the form of test tubes) constructed from, for example, polypropylene.

The purpose of the pump is to provide the volumetric flow rate of electrolyte through the transition (described elsewhere) against the pressure head it experiences on its way to overflowing the anodes (4) into the collection troughs (5) so that there exists isotropic intrinsic turbulent flow in the space between the cathode drum and the concentric two quadrant anodes. The purpose of the heat exchanger is to remove ohmic heat that is not lost by conduction and convection through the walls of the various solution circulation system components, or lost by exposure to evaporation, as in the drum machine, so as to maintain a controlled and substantially uniform temperature of the solution in fed to the drum machine, preferable such temperature being regulated to $\pm$1C variation around the preferred temperature of 60C.

Solution entering the copper scrap dissolving reactor (13) via the pipe (12) enters through a spray nozzle (13A), spraying solution downward onto scrap copper (14) in a suitable container (15). Solution enriched in copper leaves the reactor (13) via a pump (16) passing through a filter (17) and is returned via a pipe (10) to the solution reservoir (10). Evidently to maintain constant levels of solution in both the reservoir tank and in the dissolving reactor the volumetric flow rates of solution entering and leaving them should be identical, as should be the volumetric flow rate leaving the reservoir tank to the drum machine and that returning from the drum machine to the reservoir tank.

We claim:

1. An apparatus for continuous electrodeposition of metal foil comprising:
- a cylindrical drum;
- means for rotating the drum;
- a substantially semicylindrical anode shaped to fit under the drum;
- means for supplying an electrolyte in contact with the drum and the anode;
- means for sealing the anode to the drum to contain the electrolyte;
- means for passing an electric current from the anode through the solution to the drum to electrodeposit metal foil on the drum; and
- means for removing electrodeposited foil from the drum.

2. The apparatus of claim 1 wherein the cylindrical drum comprises in addition internal ribs placed to maximize uniformity of current density at an outer surface of the drum.

3. The apparatus of claim 1 wherein the means for passing an electric current are isolated electrically from any component of another apparatus for electrodeposition of metal foil.

4. The apparatus of claim 1 wherein the means for supplying an electrolyte are isolated physically from any component of another apparatus for electrodeposition of metal foil.

5. An apparatus for continuous electrodeposition of metal foil comprising:
- a cylindrical drum;
- means for rotating the drum;
- a substantially semicylindrical anode shaped to fit under the drum;
- means for supplying an electrolyte in contact with the drum and the anode, comprising a tank to receive metal to be converted into metal foil, means for spraying a solvent on the metal to dissolve the metal into solution, and means for pumping the solution from the tank to the anode and from the anode to the tank;
- means for sealing the anode to the drum to contain the electrolyte;
- means for passing an electric current from the anode through the solution to the drum to electrodeposit metal foil on the drum; and
- means for removing electrodeposited foil from the drum.

6. An apparatus for continuous electrodeposition of metal foil comprising:
- a cylindrical drum;
- means for rotating the drum;
- a substantially semicylindrical anode shaped to fit under the drum;
- means for supplying an electrolyte in contact with the drum and the anode comprising a first tank to receive metal to be converted into metal foil, a second tank connected to the first tank to supply electrolyte to the first tank and receive electrolyte from the first tank, means for spraying a solvent on the metal in the first tank to dissolve the metal into solution, and means for pumping the solution from the second tank to the anode and from the anode to the second tank;
- means for sealing the anode to the drum to contain the electrolyte;
- means for passing an electric current from the anode through the solution to the drum to electrodeposit metal foil on the drum; and
- means for removing electrodeposited foil from the drum.

7. An apparatus for continuous electrodeposition of metal foil comprising:
- a cylindrical drum;
- means for rotating the drum;
- a substantially semicylindrical anode shaped to fit under the drum;
- means for supplying an electrolyte in contact with the drum and the anode;
- means for sealing the anode to the drum to contain the electrolyte;
- means for passing an electric current from the anode through the solution to the drum to electrodeposit metal foil on the drum, comprising a first metal disc disposed on a first end of a shaft of the drum, a second metal disc disposed on a second end of the shaft opposite to the first end, a first bath of molten metal disposed to make rotating electrical contact with the first metal disc, a second bath of molten metal disposed to make rotating electrical contact with the second metal disc, a source of electric energy with a dc component, means for connecting the first and second baths to the source of electric energy, and means for connecting the anode to the source of electric energy to complete an electric circuit through the anode, the electrolyte, the drum, the first and second baths, and the first and second discs; and
- means for removing electrodeposited foil from the drum.

8. An apparatus for continuous electrodeposition of metal foil comprising:
- a cylindrical drum;
- means for rotating the drum:

a substantially semicylindrical anode shaped to fit under the drum;

means for supplying an electrolyte in contact with the drum and the anode comprising a flow transition section that maintains a substantially uniform cross-sectional area from a pipe to a slot that supplies electrolyte in a region between the anode and the drum, the pipe selected to have a length sufficient to maintain isotropic turbulent flow in the transition section and in the region between the anode and the drum;

means for sealing the anode to the drum to contain the electrolyte;

means for passing an electric current from the anode through the solution to the drum to electrodeposit metal foil on the drum; and means for removing electrodeposited foil from the drum.

9. An apparatus for continuous electrodeposition of metal foil comprising:

a cylindrical drum;

means for rotating the drum;

a substantially semicylindrical anode shaped to fit under the drum;

means for supplying an electrolyte in contact with the drum and the anode comprising an in-line filter through which the electrolyte is passed before being placed in contact with the anode and the drum;

means for sealing the anode to the drum to contain the electrolyte;

means for passing an electric current from the anode through the solution to the drum to electrodeposit metal foil on the drum; and means for removing electrodeposited foil from the drum.

10. An apparatus for continuous electrodeposition of copper foil comprising:

a cylindrical drum;

means for rotating the drum;

a substantially semicylindrical anode shaped to fit under the drum;

means for supplying an electrolyte comprising an aqueous solution of copper sulfate and sulfuric acid in contact with the drum and the anode;

means for sealing the anode to the drum to contain the electrolyte;

means for passing an electric current from the anode through the solution to the drum to electrodeposit copper foil on the drum; and means for removing electrodeposited copper foil from the drum.

11. The apparatus of claim 10 wherein the cylindrical drum comprises in addition internal ribs placed to maximize uniformity of current density at an outer surface of the drum.

12. The apparatus of claim 10 wherein the means for passing an electric current are isolated electrically from any component of another apparatus for electrodeposition of metal foil.

13. The apparatus of claim 10 wherein the means for supplying an electrolyte are isolated physically from any component of another apparatus for electrodeposition of metal foil.

14. An apparatus for continuous electrodeposition of copper foil comprising:

a cylindrical drum;

means for rotating the drum:

a substantially semicylindrical anode shaped to fit under the drum;

means for supplying an electrolyte comprising an aqueous solution of copper sulfate and sulfuric acid in contact with the drum and the anodes wherein the means for supplying an electrolyte comprises a tank to receive copper to be converted into copper foil, means for spraying a solvent comprising an aqueous solution of sulfuric acid on the copper to dissolve the copper into solution, and means for pumping the solution from the tank to the anode and from the anode to the tank;

means for sealing the anode to the drum to contain the electrolyte;

means for passing an electric current from the anode through the solution to the drum to electrodeposit copper foil on the drum; and means for removing electrodeposited copper foil from the drum.

15. An apparatus for continuous electrodeposition of copper foil comprising:

a cylindrical drum;

means for rotating the a substantially semicylindrical anode shaped to fit under the drum;

means for supplying an electrolyte comprising an aqueous solution of copper sulfate and sulfuric acid in contact with the drum and the anode;

means for sealing the anode to the drum to contain the electrolyte;

means for passing an electric current from the anode through the solution to the drum to electrodeposit copper foil on the drum comprising a first metal disc disposed on a first end of a shaft of the drum, a second metal disc disposed on a second end of the shaft opposite to the first end, a first bath of molten metal disposed to make rotating electrical contact with the first metal disc, a second bath of molten metal disposed to make rotating electrical contact with the second metal disc, a source of electric energy with a dc component, means for connecting the first and second baths to the source of electric energy, and means for connecting the anode to the source of electric energy to complete an electric circuit through the anode, the electrolyte, the drum, the first and second baths, and the first and second discs; and means for removing electrodeposited copper foil from the drum.

16. The apparatus of claim 15 wherein the first and second discs are made of copper and wherein the molten metal is selected from the group consisting of lead, bismuth, and cadmium.

17. The apparatus of claim 15 wherein the first and second discs are made of copper and wherein the molten metal is selected from the group consisting of lead, bismuth, cadmium, antimony, tin, gallium, and zinc.

18. An apparatus for continuous electrodeposition of copper foil comprising:

a cylindrical drum;

means for rotating the drum;

a substantially semicylindrical anode shaped to fit under the drum;

means for supplying an electrolyte comprising an aqueous solution of copper sulfate and sulfuric acid in contact with the drum and the anode wherein the means for supplying an electrolyte comprises a flow transition section that maintains a substantially uniform cross-sectional area from a pipe to a slot that supplies electrolyte in a region between the anode and the drum;

means for sealing the anode to the drum to contain the electrolyte;

means for passing an electric current from the anode through the solution to the drum to electrodeposit copper foil on the drum; and means for removing electrodeposited copper foil from the drum.

19. An apparatus for continuous electrodeposition of copper foil comprising:

a cylindrical drum;

means for rotating the drum;

a substantially semicylindrical anode shaped to fit under the drum;

means for supplying an electrolyte comprising an aqueous solution of copper sulfate and sulfuric acid in contact with the drum and the anode wherein the means for supplying an electrolyte comprises an in-line filter through which the electrolyte is passed before being placed in contact with the anode and the drum;

means for sealing the anode to the drum to contain the electrolyte;

means for passing an electric current from the anode through the solution to the drum to electrodeposit copper foil on the drum; and means for removing electrodeposited copper foil from the drum.

20. An apparatus for continuous electrodeposition of copper foil comprising:

a cylindrical drum;

a variable-speed motor for rotating the drum;

a substantially semicylindrical anode shaped to fit under the drum;

a tapered transition for supplying an electrolyte of aqueous copper sulfate in contact with the drum and the anode;

a source of the electrolyte connected to the tapered transition to supply the electrolyte to the tapered transition;

a pair of end plates, one of each of the pair connected to an end of the anode;

a pair of O-rings, one of each of the O-rings disposed on the drum in sealing contact with each of the end plates to seal the anode to the drum to contain the electrolyte;

a source of electric current capable of delivering a dc component of between 10,000 amperes and 120,000 amperes;

an electrical connection from the source to the anode to pass the electric current from the anode through the solution to the drum to electrodeposit copper foil on the drum; and a driven mandrel disposed to receive copper foil from the drum and wind the removed copper foil into a roll to remove the electrodeposited foil from the drum.

* * * * *